United States Patent [19]

Uekaji et al.

[11] Patent Number: 4,785,646

[45] Date of Patent: Nov. 22, 1988

[54] METHOD OF COOLING HOT-ROLLED STEEL PLATE

[75] Inventors: Hiroshi Uekaji; Kiyoshi Tanehashi, both of Oita; Masanao Yamamoto, Kimitsu; Hiroki Miyawaki, Tokyo; Harutoshi Ogai, Tokyo; Sumitada Kakimoto, Tokyo, all of Japan

[73] Assignee: Nippon Steel Corporation, Tokyo, Japan

[21] Appl. No.: 942,118

[22] Filed: Dec. 16, 1986

[30] Foreign Application Priority Data

Dec. 28, 1985 [JP] Japan ..... 60-297539

[51] Int. Cl.[4] ..... B21B 37/10; B21B 45/02

[52] U.S. Cl. ..... 72/13; 72/201

[58] Field of Search ..... 72/13, 200, 201, 202, 72/364

[56] References Cited

U.S. PATENT DOCUMENTS

| | | | |
|---|---|---|---|
| 3,604,234 | 9/1971 | Hinrichsen et al. | 72/13 |
| 3,613,418 | 10/1971 | Nara et al. | 72/13 X |
| 3,905,216 | 9/1975 | Hinrichsen | 72/13 |
| 4,274,273 | 6/1981 | Fapiano et al. | 72/13 |
| 4,569,023 | 2/1986 | Wakamiya | 72/13 X |
| 4,658,614 | 4/1987 | Wakamiya | 72/13 X |

FOREIGN PATENT DOCUMENTS

| | | | |
|---|---|---|---|
| 58-145304 | 8/1983 | Japan | 72/13 |
| 59-125210 | 7/1984 | Japan | 72/13 |

*Primary Examiner*—E. Michael Combs

[57] ABSTRACT

A method of water cooling a hot-rolled steel plate is disclosed. In this method, while a hot-rolled steel plate is being advanced lengthwise, a plurality of nozzles spray cooling water to the steel plate, and thus the plate is cooled to a predetermined temperature at a predetermined cooling rate. Before, while and after the plurality of nozzles carry out water-cooling, temperatures are consistently measured at predetermined temperature measurement points in cross-sectional areas of temperature measurement positions which are arranged lengthwise at predetermined locations of the steel plate. Each time such measurement is performed, degree of deformation of the plate is calculated on the basis of temperature differences between the temperature measurement points. When the calculated degree of deformation is not within an allowable range, corrections are made on the distribution of the water supplied by the plurality of nozzles.

13 Claims, 11 Drawing Sheets

RELATIONSHIP BETWEEN TEMPERATURE DIFFERENCE ACROSS WIDTH OF PLATE AND DEGREE OF WAVINESS

RELATIONSHIP BETWEEN EXPECTED AND MEASURED VALUES OF DEGREE OF WAVINESS

METHOD OF COOLING HOT-ROLLED STEEL PLATE

BACKGROUND OF THE INVENTION

1. Field of the Invention

The present invention relates to a cooling method in which the quality of hot-rolled steel plates is controlled in the form of a in-line production process.

2. Description of the Related Art

In general, a hot-rolled steel plate is produced by working a desired material in a rolling step, a water-cooling step or other steps. While such hot-rolled steel plate is being conveyed on the production line, the temperature within the steel plate is normally lower at the edge portion than in the middle. The cooling in the water-cooling step is commonly effected from the widthwise edges of the steel plate to the intermediate portion therebetween, from its lengthwise ends to the intermediate portions therebetween, and from its top and bottom surfaces toward the thicknesswise center. Also, the behavior of the cooling water on the top surface of the steel differs from that on the bottom surface thereof, and this causes a difference between the cooling rates applied on the top and bottom surfaces. Accordingly, when each portion of the steel plate is cooled at a different cooling rate, an anisotropic internal stress is locally formed in the steel plate, thereby impairing the shape thereof.

Various proposals have heretofore been made with respect to methods of preventing the occurrence of such shape deformations.

However, where the prior-art methods are applied to a continuous production line for a steel plate, they encounter outstanding problems. The following description concerns typical problems relating to the prior art.

(1) In one method, the rate of the cooling water supplied onto the top and bottom surfaces of the steel plate is adjusted by considering the states of the two cooled surfaces.

As an example, the following method has generally been adopted. In order to equalize the cooled states of the top and bottom surfaces, a suitable ratio as between the supply rates on the top and bottom surfaces is empirically calculated and an associated water cooling means is controlled on the basis of the thus-obtained suitable ratio, thereby allowing the shape of the steel plate to be precisely controlled. However, this prior-art method fails to provide a completely satisfactory effect with respect to preventing the occurrence of defective shape formation in the production of steel plates. To overcome the disadvantages, the specification of Japanese patent unexamined publication No. 87914/1985 proposes a method of providing symmetrical water cooling in the direction of the thickness of the steel plate. Specifically, in this method, the temperatures of the top and bottom surfaces of the plate are measured before the commencement of spraying cooling water, the conditions for setting the rate at which water is sprayed onto these two surfaces being calculated through arithmetic operations, so that the temperature difference between the top and bottom surfaces of the water-cooled steel plate may be controlled within an allowable range, and, the rate at which water is sprayed onto these surfaces of the ensuing steel plate to be water cooled being corrected, on the basis of the value of the temperature difference measured upon completion of the water cooling. As compared with the prior-art methods employing such empirically obtained value for the rate at which water is to be sprayed onto the top and bottom surfaces, the method described in the Japanese patent unexamined publication No. 87914/1985 is capable of reducing the proportion of defective shape formation in the production of a sheet plate. However, this method cannot perfectly prevent the occurrence of such defective shape formation. This is because, even if there is no temperature difference between the top and bottom surfaces when water cooling is completed, if there is any temperature difference therebetween during the water cooling, stress is generated asymmetrically along the thickness of the steel plate, thus leading to the defective shape formation in the production of the steel plate.

(2) Proposals have been made with respect to method of cooling the middle portion of the steel plate more positively than the widthwise edges of the same. This is because, since a non-uniform temperature distribution is formed in the widthwise direction of the steel plate during control of the cooling of a hot-rolled steel plate, when the steel plate is cooled to an ambient temperature range, shape defects such as waves or cambers are formed on the steel plate.

In order to prevent such shape defects, the specification of Japanese patent unexamined publication No. 87914/1985 proposes a method of cutting off cooling water from the widthwise edge portions of the steel plate so that such portions will not be excessively cooled as compared with the center.

In addition, the Japanese patent unexamined publication No. 87914/1985 proposes a concrete control method on the premise that it is possible to control the rate at which cooling water is sprayed in the widthwise direction of the steel plate. Specifically, in this method, the temperature of the plate is measured before the commencement of water cooling, the conditions for setting the rate at which the water is sprayed onto these two surfaces being calculated through arithmetic operations so that the temperature difference in the widthwise direction of the steel plate may be controlled within an allowable range, thereby applying a water cooling to the ensuing hot rolled steel plate in a controlled manner on the basis of the value of the temperature measured upon completion of the water cooling.

In order to improve the prior-art techniques, the applicant of this invention has proposed the method disclosed in the specification of Japanese patent unexamined publication No. 174833/1985. This method contemplates the fact that, when the physical properties of the steel plate such as its linear expansion coefficient and specific heat are abruptly varied by $Ar_3$ transformation during a water cooling step and thus $Ar_3$ transformation proceeds in a varied manner in the widthwise direction of the steel plate, an internal stress or a plastic strain is generated in the steel plate, so that shape defects such as waves and cambers are formed on the steel plate when it is water cooled to ambient temperatures. In this method, the supply of water in the widthwise direction is controlled during a water cooling step so that the $Ar_3$ transformation in the middle portion in the widthwise direction of the steel plate may proceed simultaneously with or after that which takes place in the widthwise edge portions of the same.

The method described in the specification of Japanese patent unexamined publication No. 174833/1985 is intended for controlling the widthwise spraying of cooling water so that the temperature difference of the steel plate in the widthwise direction may be controlled within an allowable range when the water cooling is completed. However, the present inventor has found that it is difficult to perfectly prevent the occurrence of shape defects such as waves and cambers in the steel plate merely by cooling the plate so that the temperature distribution may be uniform in the widthwise direction when the water cooling is completed.

The specification of Japanese patent unexamined publication No. 174833/1985 is intended for solving the above-mentioned problem, and is designed to control the rate at which cooling water is supplied in the widthwise direction so that, as described above, the $Ar_3$ transformation in the widthwise edge portions of the steel plate may proceed simultaneously with or after that which takes place in the middle portion in the widthwise direction. However, in an actual application of this method, since there is presently no practical means for detecting the commencement and the end of the $Ar_3$ transformation, the control steps must entirely rely on a forecasting type of calculation. Moreover, there is a further problem in that it is impossible to confirm the probability of the result obtained from such forecasting calculation being correct.

As can be seen from the foregoing, although the prior-art methods are theoretically proper, there is no, practicable means for carrying them out. Thus, none of them provides any effective solution to the aforementioned problems.

SUMMARY OF THE INVENTION

Accordingly, an object of the present invention is to provide a method of producing a hot-rolled steel plate comprising the steps of:

arranging predetermined temperature measurement locations in successive places within a water-cooling process;

arranging predetermined temperature measurement positions (hereinafter referred to as "predetermined lengthwise positions"), along which predetermined temperature measurement points are arranged in the direction of thickness of the steel plate, continuously or at specified intervals throughout the length of the steel plate;

measuring the temperature at each of the predetermined lengthwise temperature points;

calculating the temperature differences between the predetermined temperature measurement points on the basis of the thus-measured temperatures;

forecasting the extent of deformation of the steel plate on the basis of the thus-calculated temperature differences; and finely controlling cooling conditions necessary for maintaining the temperature differences so that the extent of deformation may be controlled within an allowable deformation range;

whereby it is possible to produce a steel plate having a precise shape.

To this end, the present invention provides a method of cooling a hot-rolled steel plate in which, while a hot-rolled steel plate is being advanced lengthwise, the distribution of cooling water supplied to the opposite surfaces of the steel plate is controlled along the length and width of the steel plate by a plurality of nozzles disposed face-to-face adjacent to the opposite surfaces of such steel plate and in the lengthwise and widthwise directions of predetermined water cooling zones provided along a passage through which such steel plate is advanced, thereby cooling the steel plate P to a predetermined temperature at a predetermined cooling velocity, which comprises the steps of: detecting the temperature at a first group of temperature measurement points which are set over the width of the steel plate in the direction of the thickness in cross-sectional areas of predetermined lengthwise positions of the steel plate P; and a second group of temperature measure points which are set along the width in the cross-sectional areas, before, during and after water cooling; calculating the temperature differences between the temperature measurement points in the direction of either the width or the thickness with respect to such width each time the detection is performed; forecasting the value of a bending deformation in the widthwise and lengthwise direction of the steel plate after the cooling process, on the basis of the obtained temperature differences, each time the calculation is performed; and controlling and correcting by means of the plurality of nozzles the distribution of the rate at which cooling water is being supplied to a steel plate and the rate at which the cooling water should be supplied to the ensuing steel plate whenever the forecasted extent of deformation exceeds an allowable range.

In accordance with the cooling method of this invention, the accuracy of cooling control is furtter improved and a steel plate having a good shape can be produced, thereby providing great improvements in the quality of products and reduction in cost.

The above and other objects, features and advantages of the present invention will become apparent from the following description of the preferred embodiments thereof, taken in conjunction with the accompanying drawings.

DESCRIPTION OF THE PREFERRED EMBODIMENTS

If the temperature distribution in a steel plate is perfectly uniform throughout the entire cooling process, the shape of the cooled steel plate is not impaired, but this is actually impossible. On the other hand, such temperature distribution includes an allowable range which is substantially harmless in industrial terms.

Figure 3:
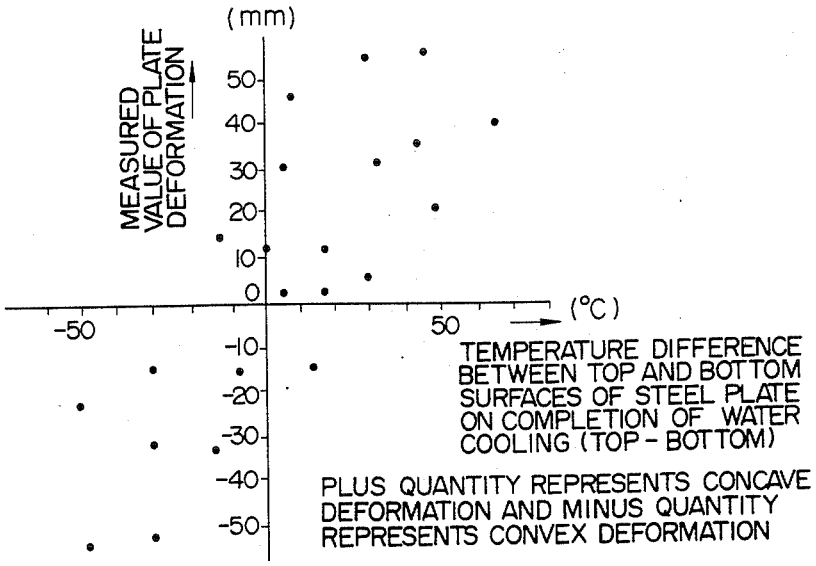
FIG. 3 is a graph of the relationship between the temperature difference between the top and bottom surfaces of the steel plate and the extent of deformation of the same when water cooling is completed.

FIG. 3 shows the relationship between the temperature difference between the top and bottom surfaces of the steel plate and the extent of deformation of the same upon completion of water cooling (the extent is represented as the amount of warpage.) The allowable range of the bending deformation of the steel plate is normally about ±5 mm. As can be seen from FIG. 3, there is a certain correlation between the deformation of the steel plate and the temperature difference between the top and bottom surfaces of the same. However, the extent of deformation of the steel plate cannot be controlled within the allowable range merely by eliminating the temperature difference between the top and bottom surfaces of the steel plate when the water cooling process is completed, and thus shape control is limited.

Figure 5:
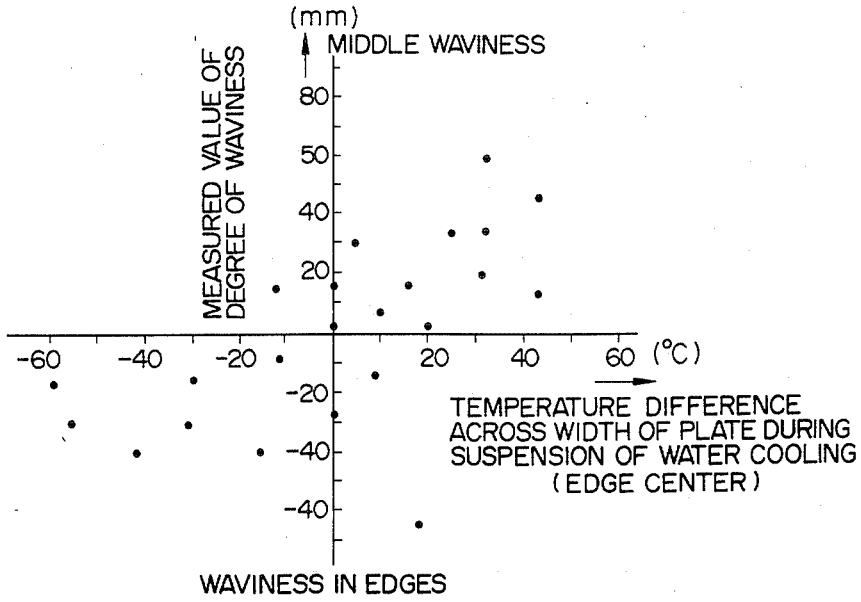
FIG. 5 is a graph of a correlation between widthwise temperature difference and the extent of deformation of a steel plate when water cooling is completed.
Figure 6:
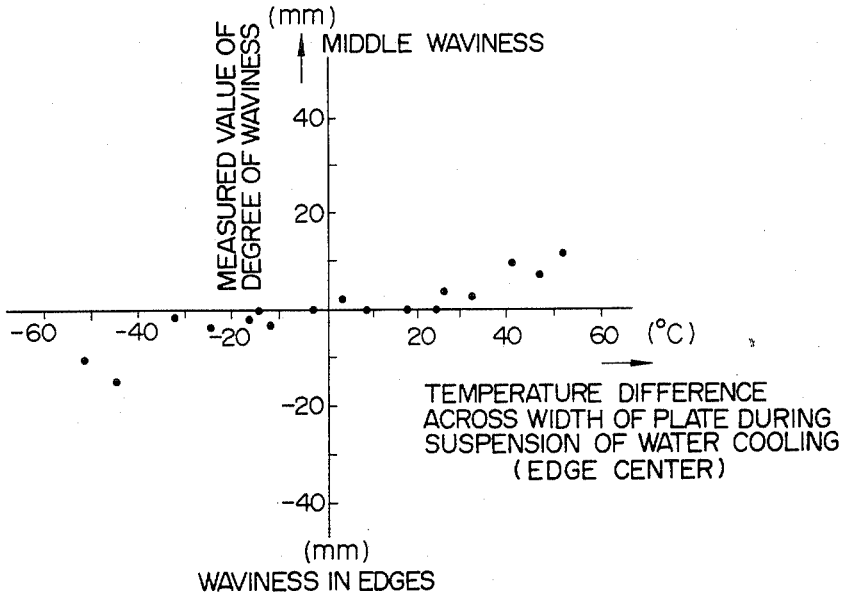
FIG. 6 is a graph of a correlation between the expected values and the measure values of the steel plate.

FIG. 5 is a graph similar to FIG. 6, but showing the relationship between the temperature difference between the widthwise edge portions of the steel plate and the center portion therebetween; and the extent of bending deformation of the steel plate. As can be seen from FIG. 6, there is a certain correlation, similar to FIG. 3, between the temperature difference in the widthwise direction of the steel plate and the extent of bending deformation of the same upon completion of the water cooling process. However, it will be understood that such extent of deformation cannot be sufficiently controlled within the allowable range merely by eliminating the widthwise temperature difference upon completion of the water cooling process.

Therefore, not only upon completion of the water cooling process but also before and during the same process, detection is made of the temperatures in the widthwise directions of each of the top and bottom surfaces at the predetermined lengthwise points of the steel plate, and calculation is made as to the temperature distribution in the directions of thickness and/or width with respect to the predetermined lengthwise positions of the steel plate. Thus, cooling conditions are controlled in the directions of the thickness, length and/or width of the same or ensuing steel plate so that the temperature distribution will be controlled within a desired temperature range. Simultaneously, forecasting operations are performed on the extent of the steel plate deformation at ambient temperatures upon completion of water cooling, on the basis of the temperature differences between predetermined temperature measurement points within the thus-obtained temperature distribution, and the aforementioned control is carried out so that the temperature difference may be obtained within a predetermined allowable range. In this fashion, it is possible to substantially prevent an anisotropic stress from locally occurring in the steel plate due to such temperature difference which might cause the unallowable bending deformation of the steel plate, and yet it is possible to cool the steel plate to provide a desired quality of the steel.

The temperatures are detected at the predetermined temperature measurement points which are arranged along the predetermined lengthwise points of the steel plate and in the direction of the thickness of the steel plate. Similar to FIG. 3, calculation is made as to the relationship between: the extent of bending deformation of the plate in widthwise and lengthwise direction; and the averaged value of the temperature differences between the predetermined temperature measurement points in the direction of the thickness of the steel plate. It has been found that, as the result of the averaged value being subjected to double regression analysis, a extent of deformation $U_O$ of the steel plate can be represented by the following regression equation (1):

$$U_0 = \sum_{\iota} a_{\iota} \cdot T_{\iota} + k \qquad (1)$$

where the symbol $\iota$ represents of the position of the thermometers disposed widthwise on the top and bottom surfaces of the entry end, the intermediate portion and the exit end of a controlled cooling device, the symbol T represents an averaged value of the temperature differences between the temperature measurement points in the direction of the thickness of the steel plate, such temperature differences being calculated each time the respective predetermined lengthwise positions arrive at the positions where the thermometers are disposed, symbol a represents an influence factor relating to T, and the symbol k is a constant.

Figure 4:
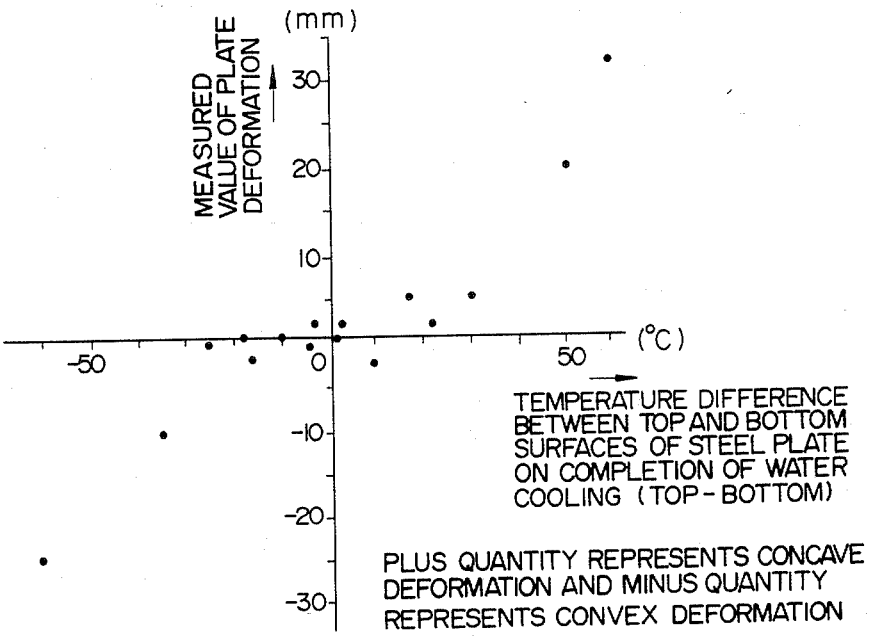
FIG. 4 is a graph of a correlation between the expected values of deformation of the steel plate and the measured values of the same.

FIG. 4 is a graph showing the result of controlling the rate at which cooling water is supplied lengthwise on the entire top and bottom surfaces of the plate, on the basis of the techniques of the present invention, so that the expected value $U_0$ of the bending plate deformation will be controlled within the allowable range. In this graph, the abscissa represents a temperature difference provided between the center and edge portions in the thicknesswise direction of the steel plate upon completion of the cooling process, while ordinate represents the extent of plate deformation. Although the allowable range of the the deformation of the steel plate is ±5 mm, and the points plotted out of the allowable range represent the values relating to the head of a material lot to be cooled. As will be evident from the FIG. 4, the actual deformation of the steel products can be adjusted as desired by controlling the cooling conditions on the basis of the expected value $u_0$ of the plate deformation during the whole period for cooling the entire steel plate.

Similarly, if the rate at which water is supplied in the widthwise direction is controlled so that the expected extent of waviness formed on the steel plate will be controlled within the allowable range, the value of deformation measured in the widthwise direction can be controlled within a predetermined range.

FIG. 6 is a graph of the result derived from the control of the rate at which the rate of supply of cooling water is controlled in the widthwise direction, on the basis of the techniques of the present invention, so that the expected value $U_0$ of the extent of bending plate deformation is controlled within the allowable range. In this graph, the abscissa represents a temperature difference between the widthwise edge portions and the center portion therebetween in the direction of the thickness of the steel plate when the water cooling process is completed, and ordinate represent a measured value of the degree of the waviness formed on the steel plate. The allowable range of the degree of the waviness formed on the steel plate is ±5 mm, and, in FIG. 6, the points disposed out of such allowable range represents values relating to the head of the material lot to be cooled.

Similar to the previously described case of controlling cooling conditions with respect to the top and bottom surfaces of the steel plate, the expected values of the deformation are calculated from the equation (1) throughout the length of the steel plate, on the basis of the temperature difference between the middle portion and the widthwise edge portions of the steel plate, and if the cooling conditions are corrected on the basis of the values of such temperature differences so that the thus-obtained expected values of the deformation is controlled to zero or within the allowable range, the proportion of defective shape formation can be controlled within an allowable range in the widthwise and lengthwise directions of the steel plate.

In this fashion, the present invention is arranged to correct cooling conditions so that the extent of bending deformation in the lengthwise and widthwise direction of the steel plate is controlled within an allowable range, and it is possible to quickly and exactly detect abnormalities such as failure and breakage of a water-supply adjustment mechanism (for example, a high-speed three-way switchover valve, water-supply control valve, and an actuator or driver for valves) incorporated in the controlled cooling device by detecting whether or not the temperature difference charges after the water-cooling conditions have been corrected, where or not the expected value of plate deformation change within the allowable range, or whether or not the extent of deformation greatly differs from the normal extent even if any change occurs in such extent.

The present invention will be described below in detail with reference to illustrated preferred embodiments. The following illustrative description concerns a cooling control method in which temperature differences between the temperature measurement points on the top and bottom surfaces are controlled in the directions of thickness and width throughout the length of the steel plate.

Figure 1:
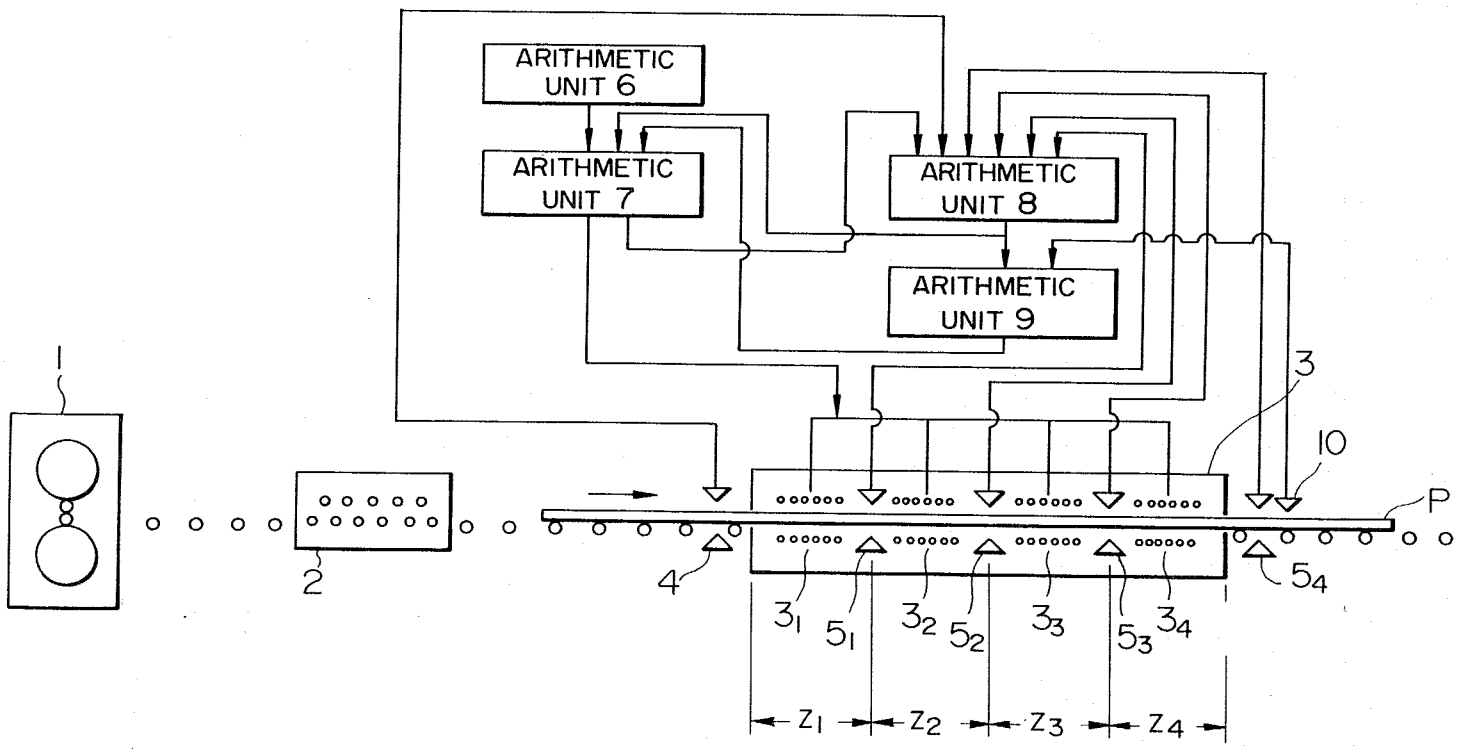
FIG. 1 is a diagrammatic view of the entire construction of the system incorporating a first preferred embodiment of a cooling method in accordance with the present invention.
Figure 7:
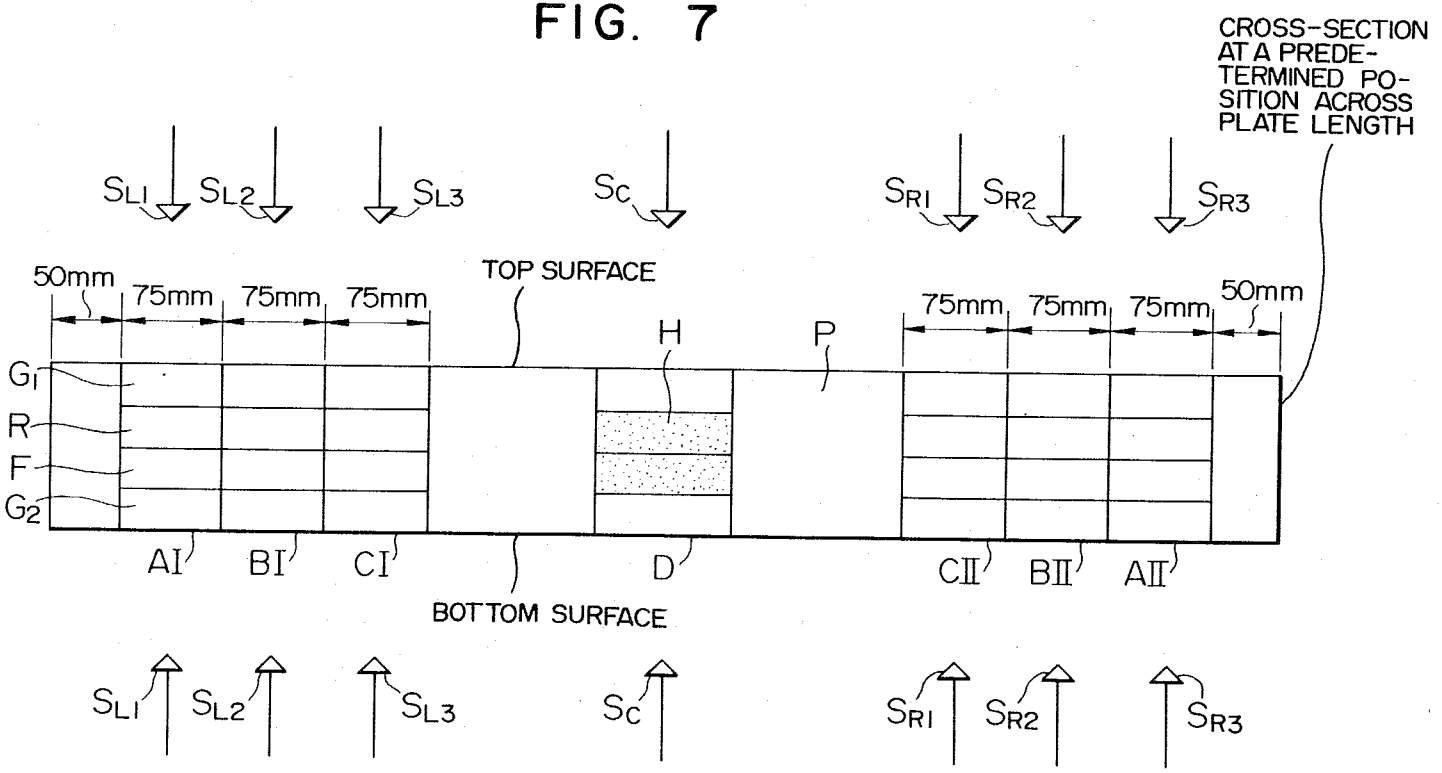
FIG. 7 is a diagram of an example of the way of dividing the temperature measurement points which are arranged to calculate the thicknesswise and widthwise temperature differences at the cross-sectional area of one of the predetermined lengthwise positions of a steel plate to be measured.

FIG. 1 is a diagram of the entire construction of the system in which the present invention is applied to prevention of a defective shape from being formed by temperature differences between the temperature measurement points arranged in the predetermined lengthwise positions in the direction of the thickness of the steel plate. The system illustrated in FIG. 1 includes: a finishing mill 1 for thick steel plates; a hot straightening machine 2, a cooling device 3, a group of water-supply headers $3_1$ to $3_4$ disposed widthwise of cooling zones $Z_1$ to $Z_4$, lengthwise at predetermined intervals, and each of the header $3_1$ to $3_4$ having a high-speed three-way switchover valve in the entry pipe portion. Each of the headers is provided with a plurality of nozzles (not shown), each having a ball valve, the opening of which is set by a striker in such a manner as to be capable of adjusting the distribution of water supplied widthwise on the top and bottom surfaces of the steel plate P. The system shown in FIG. 1 further includes a thermometer group 4 disposed in the vicinity of the entry end of the cooling device 3, a group of thermometers $5_1$ to $5_4$ disposed between the respective cooling zones $Z_1$ to $Z_4$ within the cooling device 3, and a thermometer group $5_4$ disposed in the vicinity of the exit end of the cooling device 3, each of the thermometer groups being arranged widthwise at their respective locations above and below the steel plate. The steel plate P to be water cooled is advanced in the direction of an arrow as viewed in FIG. 1. Each of the thermometer groups 4, $5_1$, $5_2$, $5_3$ and $5_4$ is constituted by radiation pyrometers incorporating optical fibers. In the first embodiment, as shown in FIG. 7, a plurality of light receiving ends are arranged widthwise above and below the steel plate P in face-to-face relaticnship, and the pairs $S_{R1}$, $S_{R2}$ and $S_{R3}$ are respectively disposed face-to-face above and below edge sections $A_I$, $B_I$ and $C_I$, while pairs $S_{L1}$, $S_{L2}$ and $S_{L3}$ are respectively disposed face-to-face above and below edge sections $A_{II}$, $B_{II}$ and $C_{II}$ which are formed in the widthwise direction of the steel plate. A pair $S_C$ is disposed face-to-face above and below a center portion D of the steel plate P. The positions of the light receiving ends $S_C$ of the pyrometer are fixed, while the respective groups $S_{R1}$, $S_{R2}$ and $S_{R3}$; $S_{L1}$, $S_{L2}$ and $S_{L3}$ are movably positioned at predetermined intervals inward from the corresponding edges of the plate P by the motion of a screw mechanism which is controllably driven by an edge copying machine (not shown) in a manner guided from information on plate width. In FIG. 7, the sections defined in the region of 50 mm inward from the opposite edges dissipate a large amount of heat and provides factors which might disturb information for controlling, so that these sections are not measured. The sections AI, BI, CI, AII, BII and CII, each having a width of 75 mm, are arranged in the intermediate portion of the steel plate P in such a manner that the positions of the sections correspond to the pitches between the respective cooling-water supply nozzles for the purpose of measuring temperature.

The stress which greatly affects the deformation of the steel plate after the controlled cooling process is generated within the region of about 50 to 250 mm inward from the edge, i.e., within the range including the sections AI, BI and CI; AII, BII and CII as viewed in FIG. 7. Symbol H represents a standard temperature of the steel plate P which is calculated by an equation for forecasting the inner temperature of a common steel plate on the basis of the surface temperatures of the center portion D in the widthwise direction of the steel plate P. The standard temperature H is obtained as the averaged temperature between the layers E and F which is continuously calculated in the lengthwise direction of the steel plate P and is displayed at each of the predetermined lengthwise positions, being used for controlling the rate of cooling the entire steel plate P and a temperature at which cooling is terminated.

Referring to FIG. 1, the system further includes a primary arithmetic unit 6 which supplies an arithmetic unit 7 with various conditions such as the kinds of a plate, rolling conditions, plate size, cooling conditions, lengthwise positions along which temperatures are measured, and pcsitions at which thermometers are arranged. The arithmetic unit 7 determines conditions necessary for setting the rate at which cooling water is sprayed to the top and bottom surfaces of the plate through the respective groups of the top and bottom water-supply headers $3_1$ to $3_4$ or nozzles (not shown).

Figure 2:
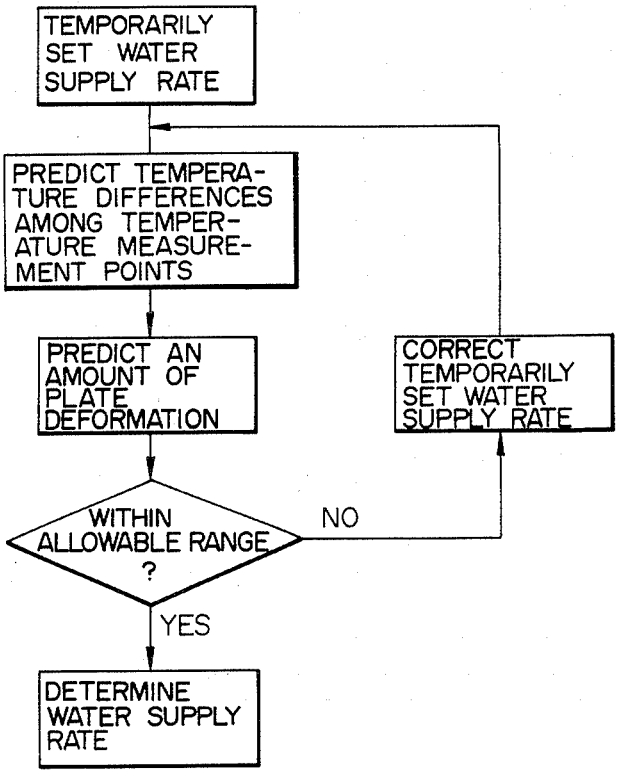
FIG. 2 is a flow chart of an example of the arithmetic means for carrying out the method of the present invention.

FIG. 2 is a flow chart of procedures for determining the conditions for setting the rate at which cooling water is supplied to the top and bottom surfaces of the steel plate. The following description concerns such procedure. As described above, the arithmetic unit 7 reads from the arithmetic unit 6 cooling conditions such as plate sizes, a cooling rate, a temperature at which rolling is terminated. The arithmetic unit 7 then temporarily sets the conditions for setting the rate at which cooling water is supplied to the top and bottom surfaces in the water cooling zones $Z_1$ to $Z_4$ of the steel plate P. Based on the temporarily set conditions, the arithmetic unit performs operations on the expected temperature differences between the respective temperature measurement points in the thicknesswise direction of the steel plate P, such expected value being obtained each time the respective predetermined lengthwise positions of the steel plate arrive at the positions of the thermometer groups (the boundaries between the water cooling zones). The predetermined lengthwise positions are arranged in the following manner. Two positions are set at locations 500 mm inward of the lengthwise ends. The intermediate portion therebetween is quartered, and the other three positions are set at the boundaries between the respective quarters, that is, a total rf five positions are provided throughout the length oi the steel plate P. Subsequently, the extent of bending deformation in each of the water cooling zones $Z_1$ to $Z_4$ is calculated from the thus-obtained expected temperature differences at the predetermined lengthwise positions in the steel plate P and from the previously noted equation (1).

If the calculated extent of deformation is within an allowable range at ambient temperatures, it is decided that the temporarily set conditions should be utilized as completely set conditions for determining the rate at which cooling water is supplied to the top and bottom surfaces of the respective water cooling zones $Z_1$ to $Z_4$. On the other hand, if the extent of deformation exceeds the allowable range at ambient temperatures, the temporarily set conditions are corrected by repeated arithmetic operations until such deformation is controlled in the allowable range. In this manner, determination is made with respect to conditions for setting the rate at which wave is supplied to the top and bottom surfaces of the respective water cooling zones $Z_1$ to $Z_4$ so that the extent of plate deformation at ambient temperatures may be controlled within the allowable range. Simultaneously, calculation is made as to the expected temperature differences between the respective temperature measurement points in the direction of the thickness of the plate which should be obtained each time the predetermined lengthwise positions arrive at the positions of the respective thermometer groups.

After the arithmetic unit 7 has determined the conditions for setting the rate at which water is supplied to the top and bottom surfaces of the plate, while the steel plate is being passed through the cooling device 3 for cooling purposes, the thermometer groups 4 and $5_1$ to $5_4$ respectively measure the temperatures of the top and bottom surfaces of the steel plate P. As described previously, such thermometer groups correspond to the predetermined lengthwise positions which are arranged in such a manner that two positions are set at locations 500 mm inward of the lengthwise ends, the intermediate portion therebetween being quartered, and other three positions being set at the boundaries between the respective quarters, that is, a total of five positions are provided througtout the length of the steel plate P Specifically, the respective thermometer groups measure the temperatures in the widthwise edge portions and the center portion therebetween at such five positions.

The system shown in FIG. 1 further includes an arithmetic unit 8 for data processing. On the basis of the temperatures calculated each time the predetermined lengthwise positions arrive at the five positions of the thermometer groups 4 and $5_1$ to $5_4$ the arithmetic unit 8 calculates the temperatures in the layers E and F in the previously-described sections AI, BI, CI, AII, BII and CII which are provided in the thicknesswise direction of the plate. Subsequently, the unit 8 compares the respective temperatures thus calculated, calculating the temperature differences, selecting the maximum temperature difference therefrom, and outputting the selected value to the arithmetic units 8 and 9 in the form of an actually measured value. In accordance with this input value, the arithmetic unit 7 corrects the expected value of the temperature differences which, prior to the water cooling process, are used to determine the rate at which cooling water is supplied to the top and bottom surfaces of the water cooling zones $Z_1$ to $Z_4$ then correcting the content of T in the previously noted equation (1). The new T is used to correct the rate of supply of the cooling water applied to the same or ensuing steel plate. Although the temperatures in the layers E and F are calculated on the basis of the temperatures in the steel plate which are obtained from the measured surface temperatures by using a known equation for forecasting the internal temperature of steel plates, the temperatures in layers $G_1$ and $G_2$ adjacent to the top and bottom surfaces may also be calculated for similar forecasting purpose. Where the thickness of a plate is not greater than 16 mm, surface temperatures measured are directly used. Where the thickness is greater than 20 mm, use is made of the temperatures of the layers $G_1$ and $G_2$ or E and F in the steel plate which are calculated by the previously described forecasting equation on the basis of the surface temperatures. Within the range from 16 to 20 mm, either the surface temperatures measured or the internal temperatures forecasted could be used case-by-case, and the present invention can employ either of them.

The system shown in FIG. 1 further includes an arithmetic unit 9 for determining the corrected rate at which cooling water is supplied to the top and bottom surfaces of the steel plate. The arithmetic unit 9 receives the previously-descried actual measurements of the temperature differences between the layers E and F which are determined by the arithmetic unit 8, and the plate-shape signal supplied from a shape sensor 10, substituting new values for the variables of the equation (1), recalculating the correction influence factor a and/or the constant k in the equation (1) stored in the arithmetic unit 7, and outputting the result to the arithmetic unit 7, thereby applying the thus-corrected equation to the ensuing steel plate to be water cooled.

Table I shows: the expected values of the degree of plate bending deformation which are calculated on the basis of the results of actual measurement of the temperature differences between the temperature measurement points arranged in the direction of the thicknesses of the respective file temperature measurement positions along the length of the steel plate; corrected values of the rate of water supplied to the top and bottom surfaces; and measured values of the plate deformation when steel plates having the same sized are continuously cooled.

TABLE I

| COOLING ORDER | 1 | 2 | 3 | 4 |
|---|---|---|---|---|
| WATER SUPPLY ($m^3/m^2$ per min.) | | | | |
| ZONE $Z_1$ | | | | |
| (top) | 0.4 | 0.38 | 0.35 | 0.4 |
| (bottom) | 0.6 | 0.6 | 0.6 | 0.6 |
| ZONE $Z_2$ | | | | |
| (top) | 2 | 0.38 | 0.35 | 0.35 |
| (bottom) | 0.6 | 0.6 | 0.6 | 0.6 |
| ZONE $Z_3$ | | | | |
| (top) | 0.4 | 0.38 | 0.35 | 0.35 |
| (bottom) | 0.6 | 0.6 | 0.6 | 0.6 |
| ZONE $Z_4$ | | | | |
| (top) | 0.4 | 0.38 | 0.35 | 0.35 |
| (bottom) | 0.6 | 0.6 | 0.6 | 0.6 |
| THICKNESSWISE TEMP. DIFFERENCE IN PLATE (TOP-SURFACE TEMP. MINUS BOTTOM-SURFACE TEMP. (°C.)) | | | | |
| BEFORE COOLING | −70 | −70 | −70 | −70 |
| EXIT END OF ZONE $Z_1$ | −70 | −60 | 5 | −5 |
| EXIT END OF ZONE $Z_2$ | −50 | −15 | 15 | 0 |
| EXIT END OF ZONE $Z_3$ | −50 | −20 | 25 | 15 |
| EXIT END OF ZONE $Z_4$ | −20 | −10 | 10 | 10 |
| AFTER COOLING | | | | |
| EXPECTED DEGREE OF PLATE DEFORMATION BASED ON MEASURED TEMPERATURE DIFFERENCE (mm) | −30.3 | −10 | 10 | 3 |
| CORRECTION OF WATER-SUPPLY RATE | REQUIRED | REQUIRED | REQUIRED | NOT REQUIRED |
| MEASURED DEGREE OF PLATE DEFORMATION (mm) | −28 | −11 | 9 | 2 |

NOTE:
PLATE SIZE: 25 × 3,000 × 18,000, PLATE FEED VELOCITY 60 m/MIN.
WATER-COOLING RANGE: 750 to 450° C., ALLOWABLE PLATE DEFORMATION RANGE: ±5.0 mm.
The sign + and − prefixed to the degree of plate deformation represent the concave and convex deformations of the plate, respectively, as in the case shown in FIG. 3.
Temperature difference in the direction of plate thickness (between top and bottom surfaces) (°C.): the maximum temperature difference between the layers E and F in the sections AI, BI, CI, AII, BII, and CII shown in FIG. 3 (All the temperature differences less than the maximum temperature difference are within an allowable range which is substantially harmless in industrial terms.)

Referring to Table I, on the basis of the results of a first plate to be water cooled, corrections were made on the rate at which water was supplied to the top and bottom surfaces of a second plate to be water cooled, thereby improving the extent of deformation of the second plate. However, this extent did not yet exceed the allowable range, so that the deformations of the subsequent steel plates were controlled within the allowable range.

In the first embodiment, the rate of cooling throughout the length of the plate is controlled by a known control method on the basis of the standard value H of the middle portion in the widthwise direction of the steel plate shown in FIG. 7.

SECOND EMBODIMENT

In the second embodiment, the formation of widthwise defective shapes is prevented throughout the length of steel plates.

The system shown in FIG. 1 was used, but in the second embodiment, the groups $3_1$ to $3_4$ of cooling-water supply headers are arranged to be capable of controlling the supply of nozzles (not shown) for widthwise water supply.

When the arithmetic unit 7 receives the cooling conditions from the arithmetic unit 6, the unit 7 first temporarily sets the conditions for determining the rate at which the headers supply cooling water to the associated water cooling zones. This temporary setting is performed on each of the water cooling zones and/or the headers. On the temporarily set conditions, the arithmetic unit 7 calculates the expected values of the temperatures at the widthwise temperature measurement points and those of the temperature differences between these temperature measurement points in the thicknesswise direction of the steel plate each time the predetermined lengthwise points of the steel plate (five points similar to the first embodiment) arrive at the respective positions of the thermometer groups (the boundaries between the respective cooling zones). Subsequently, the unit 7 calculates the extent of deformation in the respective water cooling zones $Z_1$ to $Z_4$ on the basis of: the expected values of the temperatures at the widthwise temperature measurement points in the thicknesswise direction of each of the predetermined lengthwise positions of this plate; those of the temperature differences therebetween; and the equation (1). Then, on the basis of the thus-obtained values, the unit 7 calculates the extent at which the steel plate is deformed at ambient temperatures. When the amount of deformation of the steel plate is within the allowable ranged at ambient temperatures, the unit 7 decides, in the same manner as the first embodiment, that the temporarily set conditions for supplying cooling water in the widthwise direction are applied to the water cooling zones and/or the headers in the form of the completely set conditions. When the extent of deformation of the steel plate exceeds the allowable range at ambient temperatures, the unit 7 repeatedly performs arithmetic operations for correcting the temporarily set conditions until such extent is controlled within the allowable range.

As described above, in the same manner as the first embodiment, determination is made as to the conditions for setting the rate at which cooling water is supplied widthwise, so that the degree of plate bending deformation is controlled within the allowable range at ambient temperatures. Simultaneously, calculation is made as to the expected values of the temperature differences between the temperature measurement points provided between the widthwise ends of the steel plate in correspondence with the positions of the thermometer groups.

While the steel plate is being passed through the cooling device 3, it is cooled therein in accordance with the conditions of the rate at which cooling water is supplied widthwise. During this time, each time the five predetermined lengthwise positions of the plate similar to the first embodiment arrive at the respective thermometer groups 4 and $5_1$ to $5_4$ arrarged as shown in FIG. 1, associated temperatures are measured at the temperature measurement point D in the center portion and the other points AI, BI, CI, AII, BII and CII in the edge portion which are formed widthwise in the plate. The data processing arithmetic unit 8 compares the temperatures measured at the points AI, BI, CI, AII, BII and CII with the temperature at the point D, and calculates the widthwise temperature differences measured between the above-mentioned respective points at the five lengthwise positions face-to-face the thermometer groups, outputting the results to the units 7 and 9. The arithmetic unit 7 corrects the expected values of the temperature differences between the widthwise temperature measurement points arranged in the direction of the thickness of the concerned lengthwise position, such values being used, before the water cooling process, so as to determine the rates at which cooling water is supplied in the directions of the thickness, width and length of the plate in the respective water cooling zone. After this correction, the unit 7 modifies the content of the variable T in the equation (1), and applies the results to the correction of the rate at which cooling water is supplied to the same or the ensuing steel plate. The arithmetic unit 9 determines the amount of the correction of the rate at which cooling water is supplied widthwise. The unit 9 receives: temperature differences between the widthwise respective temperature measurement points which are measured by the thermometer groups corresponding to the respective lengthwise positions of the plate and which are determined by the unit 8; and the signal representative of plate shape which is supplied from the shape sensor 10. Subsequently, the unit 9 substitutes the thus-obtained values for the variables in the equation (I), calculating the correction influence factor a and/or the constant k in the equation (1) stored in the unit 7, outputting the result to the unit 7, and applying this corrected equation to the water cooling of the following steel plate.

Table II shows: the expected values of the plate bending deformation which are calculated on the basis of the results of actual measurement of the temperature differences between the temperature measurement points arranged in the widthwise direction of the predetermined lengthwise positions; corrected values of the rate of supply of water to the top and bottom surfaces; and measured values of the plate bending deformation, such values being obtained when steel plates having the same sizes are continuously water cooled.

Referring to Table II, on the basis of the results of a first plate to be water cooled, corrections were made on the rate at which water was supplied in the widthwise direction of second and third plates to be cooled, thereby improving the expected extent of deformation of these plates. However, such extent were not yet controlled within the allowable range, but the deformations of the fourth and subsequent steel plates were controlled within the allowable range.

In the second embodiment, the rate of cooling effected throughout the length of the plate is controlled by a known control method on the basis of the standard value H of the middle portion in the widthwise direction of the steel plate shown in FIG. 7.

Table III shows the results in which, where the steel plate having the same size is continuously water cooled in the same manner as in Table II, abnormalities in the controlled cooling device are detected in addition to cooling conditions and are restored to the normal state.

On the basis of the results provided by a first steel plate to be water cooled, the nozzle of the #3 header corresponding to the water cooling zone $Z_1$ were adjusted to correct the region of a second plate which was supplied with water widthwise by the nozzle. However, since there were no changes in the temperature differences at the entries of the respective water cooling zones, the nozzle of the #3 header was checked. In consequence, it was found that the nozzle opening operation was impossible since an opening/closing mechanism was failed. Immediately, this abnormal state was recovered to the state wherein the normal operation was possible, and the region of a third plate which was supplied with water by the nozzle was reset, thereby effecting cooling on the third plate. Although great improvements were achieved, no expected value of the plate deformation was controlled within the allowable range. When a fourth plate was cooled, the extent of plate deformation was controlled within the allowable range.

TABLE II

| COOLING ORDER | 1 | 2 | 3 | 4 |
|---|---|---|---|---|
| ZONES WHICH ARE DEFINED BETWEEN WIDTHWISE ENDS OF STEEL PLATE AND ARE NOT DIRECTLY SUPPLIED WITH COOLING WATER BY NOZZLES OPPOSING TOP AND BOTTOM SURFACES (mm)*1 | | | | |
| ZONE $Z_1$ | | | | |
| #1 HEADER | 75 | 75 | 150 | 150 |
| #2 HEADER | 75 | 75 | 150 | 150 |
| #3 HEADER | 0 | 75 | 150 | 75 |
| ZONE $Z_2$ | | | | |
| #1 HEADER | 75 | 75 | 150 | 75 |
| #2 HEADER | 75 | 75 | 150 | 75 |
| #3 HEADER | 0 | 0 | 75 | 75 |

TABLE II-continued

| COOLING ORDER | 1 | 2 | 3 | 4 |
|---|---|---|---|---|
| ZONE $Z_3$ | | | | |
| #1 HEADER | 75 | 75 | 75 | 0 |
| #2 HEADER | 75 | 75 | 75 | 0 |
| #3 HEADER | 0 | 0 | 0 | 0 |
| ZONE $Z_4$ | | | | |
| #1 HEADER | 75 | 75 | 0 | 0 |
| #2 HEADER | 75 | 75 | 0 | 0 |
| #3 HEADER | 0 | 0 | 0 | 0 |
| WIDTHWISE TEMPERATURE DIFFERENCE IN PLATE (EDGE-PORTION TEMPERATURE MINUS MIDDLE-PORTION TEMPERATURE (°C.)) | | | | |
| BEFORE COOLING | −30 | −30 | −30 | −30 |
| EXIT END OF ZONE $Z_1$ | −50 | −40 | 10 | 0 |
| EXIT END OF ZONE $Z_2$ | −70 | −50 | 50 | 20 |
| EXIT END OF ZONE $Z_3$ | −30 | −20 | 20 | 5 |
| EXIT END OF ZONE $Z_4$ | −5 | 5 | 5 | −10 |
| AFTER COOLING | | | | |
| EXPECTED DEGREE OF PLATE DEFORMATION BASED ON MEASURED TEMPERATURE DIFFERENCE (mm) | −35.6 | −22.3 | 10.5 | 3 |
| CORRECTION OF REGION FACING NOZZLES WHICH ARE NOT SUPPLIED WITH WATER | REQUIRED | REQUIRED | REQUIRED | NOT REQUIRED |
| MEASURED DEGREE OF PLATE DEFORMATION (mm)*2 | −32 | −21 | 9 | 2 |

NOTE:
*1The positions of the widthwise edge portions of a steel plate on the side facing the nozzle groups which are not supplied with water in the respective headers are represented by distances (mm) away from the widthwise ends of the plate.
*2The sign + and − prefixed to the degree of plate deformation represent middle and edge wavinesses on the plate, respectively.
PLATE SIZE: 25 × 3,000 × 18,000, PLATE FEED VELOCITY: 60 m/min., WATER-COOLING RANGE: 750 to 450° C., ALLOWABLE PLATE DEFORMATION RANGE: ±5.0 mm.
Refer to the numbers in the column 4 in the Table 1 for the rates of water supplied to the top and bottom surfaces in each cooling zone.
Temperature difference in the direction of plate width (between the edge and center portions) (°C.): the maximum temperature differences between the center portion D and the respective sections AI, BI, CI, AII, BII, and CII shown in FIG. 7 (based on the same reason as that of the first embodiment)

TABLE III

| COOLING ORDER | 1 | 2 | 3 | 4 |
|---|---|---|---|---|
| SPECIFIED VALUES FOR ZONES WHICH ARE DEFINED BETWEEN WIDTHWISE ENDS OF STEEL PLATE AND ARE NOT DIRECTLY SUPPLIED WITH COOLING WATER BY NOZZLES FACING TOP AND BOTTOM SURFACES (mm)*1 | | | | |
| ZONE $Z_1$ | | | | |
| #1 HEADER | 75 | 75 | 150 | 150 |
| #2 HEADER | 75 | 75 | 150 | 150 |
| #3 HEADER | 0 | 75 | 150 | 75 |
| ZONE $Z_2$ | | | | |
| #1 HEADER | 75 | 75 | 150 | 75 |
| #2 HEADER | 75 | 75 | 150 | 75 |
| #3 HEADER | 0 | 0 | 75 | 75 |
| ZONE $Z_3$ | | | | |
| #1 HEADER | 75 | 75 | 75 | 0 |
| #2 HEADER | 75 | 75 | 75 | 0 |
| #3 HEADER | 0 | 0 | 0 | 0 |
| ZONE $Z_4$ | | | | |
| #1 HEADER | 75 | 75 | 0 | 0 |
| #2 HEADER | 75 | 75 | 0 | 0 |
| #3 HEADER | 0 | 0 | 0 | 0 |
| WIDTHWISE TEMPERATURE DIFFERENCE IN PLATE (TEMPERATURE DIFFERENCE BETWEEN EDGE AND PORTION TEMPERATURE (°C.) | | | | |
| BEFORE COOLING | −30 | −30 | −30 | −30 |
| EXIT END OF ZONE $Z_1$ | −50 | −50 | 10 | 0 |
| EXIT END OF ZONE $Z_2$ | −70 | −70 | 30 | 20 |
| EXIT END OF ZONE $Z_3$ | −30 | −30 | 40 | 5 |
| EXIT END OF ZONE $Z_4$ | −5 | −5 | 20 | −10 |
| AFTER COOLING | | | | |
| EXPECTED DEGREE OF PLATE DEFORMATION BASED ON MEASURED TEMPERATURE DIFFERENCE (mm) | −35.6 | −35.6 | 8 | 3 |
| CORRECTION BASED ON INCREASE AND DECREASE IN THE NUMBER OF NOZZLES WHICH DO NOT SUPPLY WATER TO COOLING ZONE | REQUIRED | REQUIRED | REQUIRED | NOT REQUIRED |
| MEASURED DEGREE OF PLATE DEFORMATION | −32 | −21 | 9 | 2 |

TABLE III-continued

| COOLING ORDER | 1 | 2 | 3 | 4 |
|---|---|---|---|---|
| (mm)*2 | | | | |

NOTE:
*1The positions of the widthwise edge portions of a steel plate on the side facing the nozzle groups which are not supplied with water in the respective headers are represented by distances (mm) away from the widthwise ends of the plate.
*2The sign + and − prefixed to the degree of plate deformation represent middle and edge wavinesses on the plate, respectively.
PLATE SIZE: 25 × 3,000 × 18,000, PLATE FEED VELOCITY: 60 m/min., ALLOWABLE PLATE DEFORMATION RANGE: ±5.0 mm.
Refer to the numbers in the column 4 in the Table 1 for the rates of water supplied to the top and bottom surfaces in each cooling zone.
Temperature difference in the direction of plate width (between the edge and center portions) (°C.): the maximum temperature differences between the center portion D and the respective sections AI, BI, CI, AII, BII, and CII shown in FIG. 7 (based on the same reason as that of the first embodiment)

The two techniques which will be illustratively described below are effectively utilized as controlled cooling means incorporating the cooling method in accordance with the present invention.

The following description concerns a first example of a controlled cooling device for hot-rolled steel plate comprising: a plurality of cooling-water spray nozzles disposed along a passage through which a hot-rolled steel plate is conveyed, such nozzles being directed to the top and bottom surfaces of the plate; a high-speed three-way switchover valve disposed in a pipe extending from the entry of a water-supply header to each of the nozzles so as to control the rate at which cooling water is supplied to each of the spray nozzles or each group of the same; and each of the high-speed three-way switchover valves being connected to a pipe through which cooling water is supplied to the cooling-water spray nozzle and another pipe which is connected to a drain pipe.

This nonlimitative controlled cooling device is a suitable means capable of providing quick and precise control of the distribution of the water supplied in the lengthwise and widthwise directions of steel plates, which is set by the controlling method in accordance with the present invention.

Figure 8:
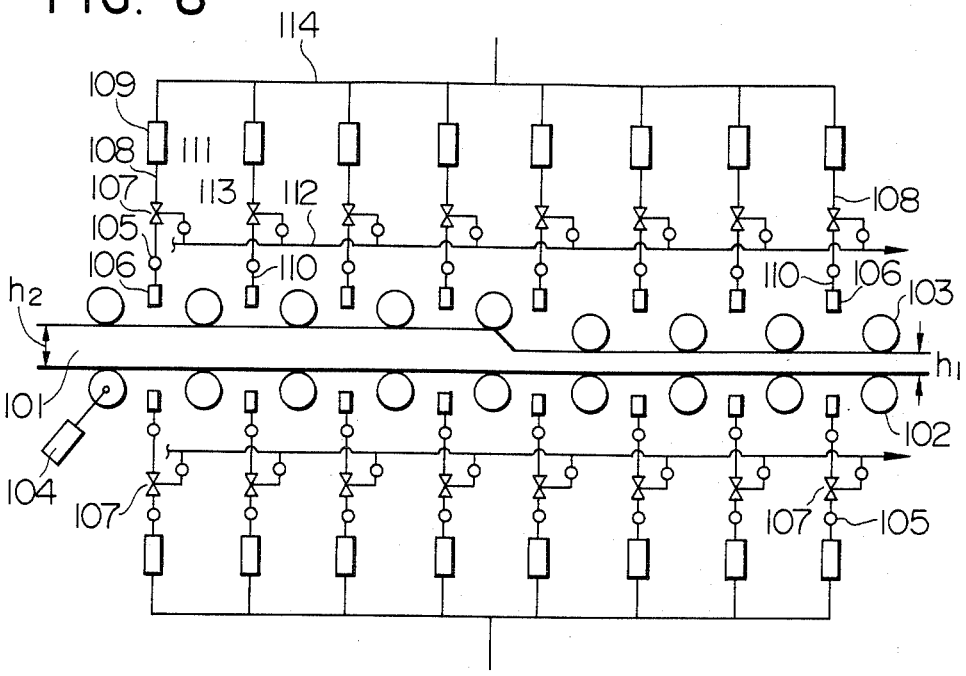
FIG. 8 is a diagrammatic view of the entire construction of a controlled cooling device for a hot-rolled steel plate which incorporates the present invention.

FIG. 8 is a diagrammatic view of the cooling water control piping system incorporated in such a controlled cooling device.

As clearly shown in FIG. 8, a steel plate 101 has a thin portion having a thickness of $h_1$ and a thick portion having a thickness of $h_2$. (The steel plate 101 is hereinafter referred to simply as "stepped plate".) The stepped plate 101 is guided between a series of feed rollers 102 and a series of retaining rollers 103 arranged in face-to-face relationship with the feed rollers 102, being conveyed at high speed from left to right as viewed in FIG. 8. Each of the feed rollers 102 is provided with a table rotation sensor 104 for tracing and detecting the feed velocity and the position of the stepped plate 101. A plurality of water-supply headers 105 are disposed in the direction normal to the direction in which the stepped plate 101 is advanced, below and above the rollers 102 and 103 in a symmetical manner. A plurality of cooling-water spray nozzles 106 are arranged at predetermined pitches along the width of the stepped plate 101, such nozzles being connected to the water supply headers 105. A high-speed three-way switchover valve 107 is disposed in each of the cooling-water supply passages constructed in this manner. The entry ends of the cooling-water supply passages are respectively connected to water supply control unit 109 via pipes 108. One exit end of each of the supply passages is connected to the water-supply header 105, while the other exit end is connected to a drain pipe 112 via a pipe 111. Each orifice 113 connected to the drain pipe 112 has an orifice diameter capable of maintaining the same level of pressure loss, whichever may be selected, the pipes 110 or 111 connected to the exits of the high-speed three-way switchover valve 107. The water supply control unit 109 are connected to a supply pipe 114 through which cooling water is supplied from a water supply unit (not shown).

Figure 9:
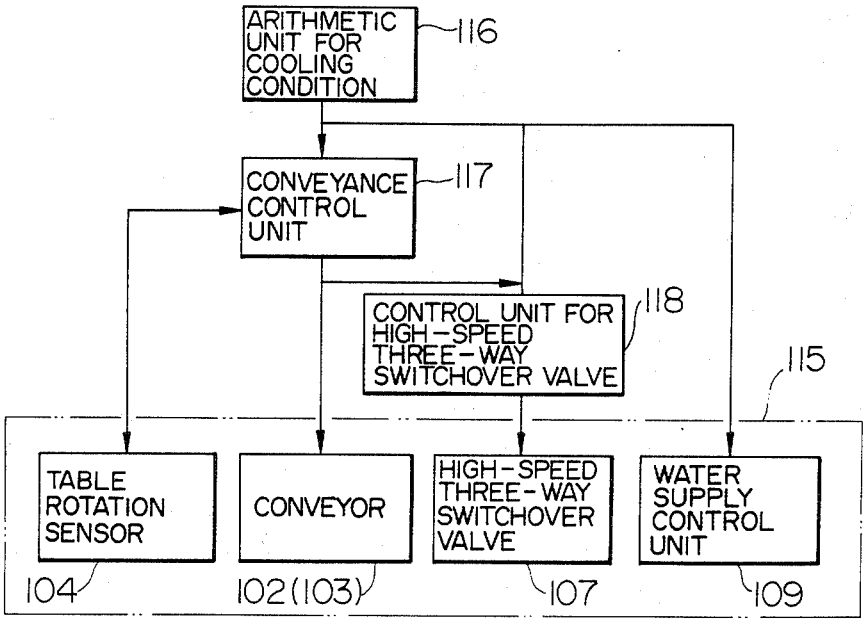
FIG. 9 is a flow chart of an example of arithmetic means incorporated in the controlled cooling device shown in FIG. 8.

FIG. 9 is a flow-chart of the control system incorporated in the controlled cooling device shown in FIG. 8.

A cooling device 115 includes components shown in FIG. 8. A cooling-condition arithmetic unit 116 performs operations on the controlling conditions required by the cooling device 115 on the basis of the size and the mechanical characteristics of the steel plate, thus controlling the cooling device 115. The procedures for control provided by the cooling-condition arithmetic unit 116 will be described below in detail with reference to FIGS. 10*a*, 10*b*, 11*a* and 11*b*

Figure 10A:
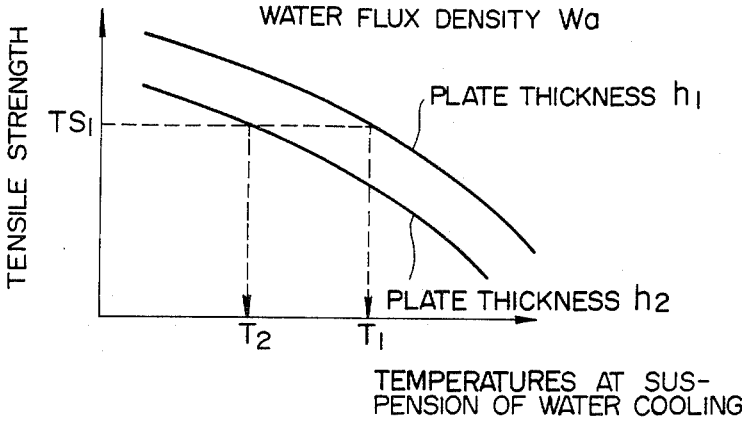
FIG. 10*a* is a graph of the relationship between a tensile strength and a temperature at which water cooling is stopped.
Figure 10B:
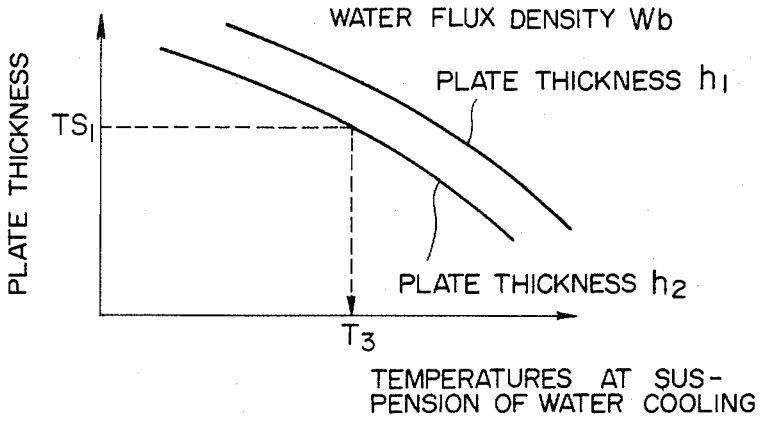
FIG. 10*b* is a graph similar to FIG. 10*a;*

The following description will be made with illustrative reference to the stepped plate 101 requiring a uniform level of tensile strength. When the value of a desired tensile strength is represented by $TS_1$, a relationship as shown in FIGS. 10*a* and 10*b* is created between a temperature at which water cooling is stopped (hereinafter referred to simply as "water cooling stopping temperature") and the tensile strength. Specifically, in order to impart the tensile strength $TS_1$ to the thick and thin portions of the stepped plate 101, either of the following methods is adopted. As shown in FIG. 10*a*, if a water flux density Wa is assumed to be fixed, the water cooling stopping temperature is set to $T_1$ with respect to the thin portion having a thickness of $h_1$, while it is set to $T_2$ with respect to the thick portion having a thickness of $h_2$. Otherwise, the water flux density could be varied as shown in FIG. 10*b*. As an example, the water flux density is set to Wa and the water cooling stopping temperature is set to $T_1$ with respect to the thin portion having a thickness of $h_1$, while the former is set to Wb and the latter is set to $T_3$ with respect to the thick portion having a thickness of $h_2$. Either of these methods can be freely selected, but if the water flux density is varied, it is possible to widen the range of the thickness of plates which can be manufactured.

Figure 11A:
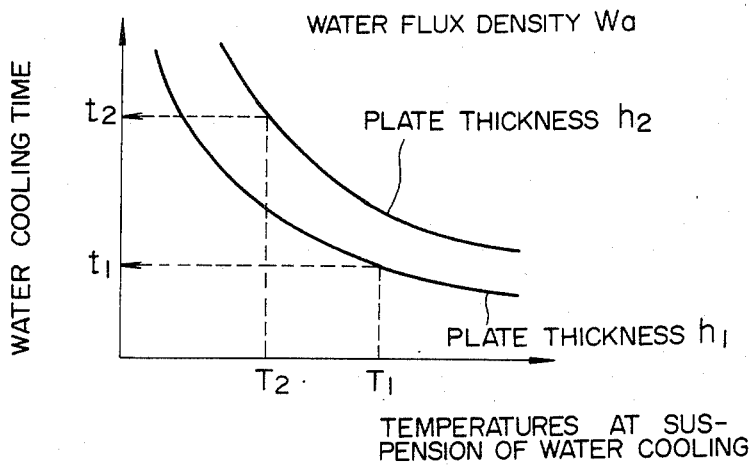
FIG. 11*a* is a graph of the relationship between cooling time and temperature at which cooling is stopped.
Figure 11B:
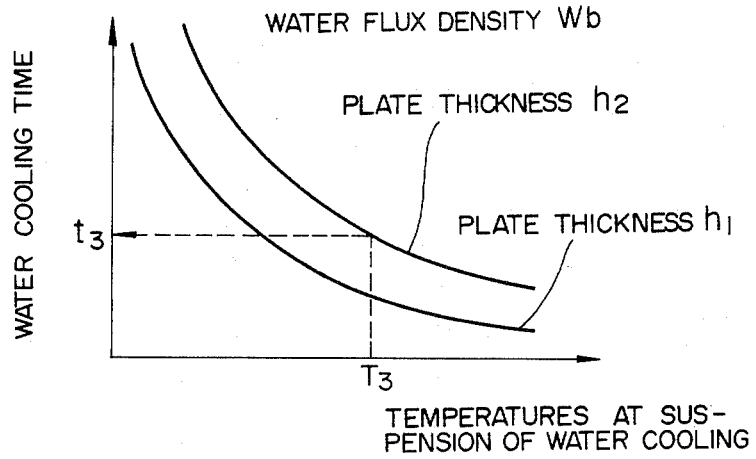
FIG. 11*b* is a graph similar to FIG. 11*a;*

Referring to FIGS. 11*a* and 11*b*, description will be made of the way of determining a feed velocity and the length of each water cooling zone necessary for providing the water flux density and the water cooling stopping temperature which are obtained in the above-described manner.

First of all, where the thin and thick portions of the stepped plate 101 are water cooled at the same level of water flux density Wa, the time required for cooling is set to $t_1$ so that the water cooling stopping temperature at the thin portion may be set to $T_1$, while the time required for water cooling is set to $t_2$ ($t_2 > t_1$) so that the temperature at the thick portion may be set to $T_2$.

A velocity V at which the stepped plate is advanced (hereinafter referred to simply as "feed velocity V") is given by the following equation (2) having variables such as the water cooling-zone length L and the required cooling time $t_2$:

$$V=L/t_2 \quad (2)$$

Specifically, when the water cooling-zone length relative to the thin portion is L, the water cooling-zone length $L_0$ relative to the thick portion is represented by $L \times t_1/t_2$. When the water flux density with respect to the thin and thick portions need to be varied, the required water cooling time is set to $t_1$ in order to provide the water cooling stopping temperature $T_1$ relative to the thin portion at the water flux density Wa, while the required water cooling time is set to $t_3$ in order to provide the water cooling stopping temperature $T_3$ relative to the thick portion at the water flux density Wb.

In this case, the feed velocity V is determined by the following equation (3):

$$V=L/(t_2+t_3) \quad (3)$$

where $L_1$ is the length of the water cooling zone corresponding to the thin portion, $L_2$ is the length of the water cooling zone corresponding to the thick portion and $L=L_2+L_3$ (the whole length of the water cooling zone).

Referring back to FIG. 9, a feed controller 117 control the feed velocity and detects the position of the stepped plate 101 within the cooling device 115 on the basis of the conditions of feed velocity supplied from the cooling-condition arithmetic unit 116, the length of the stepped plate 101 (such as the overall length, the lengths of the thin and thick portions) and the feed velocity which is measured by the rotational speed sensor 104. The rotational speed sensor 104 supplies a signal representative of the position of the stepped plate 101 to the feed controller 117. In response to such signal input, a high-speed three-way switchover valve control unit 118 controls the high-speed three-way switchover valve controllers 107 in a preset manner, and the stepped plate 101 is cooled by water supply through selected nozzles 106.

Table IV shows the results of the water cooling of stepped plates performed by the above-described controlled cooling device in comparison with the results provided by the prior-art cooling device (under the conditions of the same cooling time and the same water flux density.)

TABLE IV

| | ABOVE-DESCRIBED EXAMPLE OF CONTROLLED COOLING DEVICE | | PRIOR-ART EXAMPLE | |
|---|---|---|---|---|
| PLATE THICKNESS mm | 20 | 25 | 20 | 25 |
| WATER FLUX DENSITY $m^3/m^2$ MIN. | 0.5 | 0.6 | 0.6 | 0.6 |
| COOLING TIME sec. | 17 | 20 | 20 | 20 |
| TEMPERATURE AT THE END OF COOLING °C. | 480 | 450 | 350 | 450 |
| MEASURES VALUE | | | | |
| TENSILE STRENGTH $Kg/mm^2$ | 52 | 52 | 58 | 52 |
| ELONGATION % | 25 | 25 | 17 | 25 |
| SPECIFICATIONS | | | | |
| TENSILE STRENGTH $Kg/mm^2$ | ≧50 | ≧50 | ≧50 | ≧50 |
| ELONGATION % | ≧20 | ≧20 | ≧20 | ≧20 |

As clearly shown in Table IV, the use of a controlled cooling device incorporating the cooling method of this invention not only provdes the effect of preventing the deformation in the shape of steel plates but also enables the production of stepped plates even within the ranges of plate thickness and thickness differential in which the prior-art methods cannot achieve satisfactory mechanical characteristics of stepped plates.

The following description concerns another example which can be suitably used as effective control means for controlling the distribution of cooling water supplied to the top and bottom surfaces of steel plates in the lengthwise and widthwise directions, such distribution being set by the method of this invention. More particularly, a method of cooling hot steel plates in which a plurality of nozzles disposed widthwise above and below a hot steel plate are arranged to supply cooling water to the hot steel plate in a controlled manner while the hot steel is being advanced lengthwise on a conveyor line, being characterized in that the rate at which water is supplied to each group of the nozzles arranged widthwise is adjusted during cooling so that the widthwise temperature difference may be less than a desired value in accordance with various conditions such as plate thickness, plate width, cooling starting temperature, cooling velocity and cooling terminating temperature.

Figure 13:
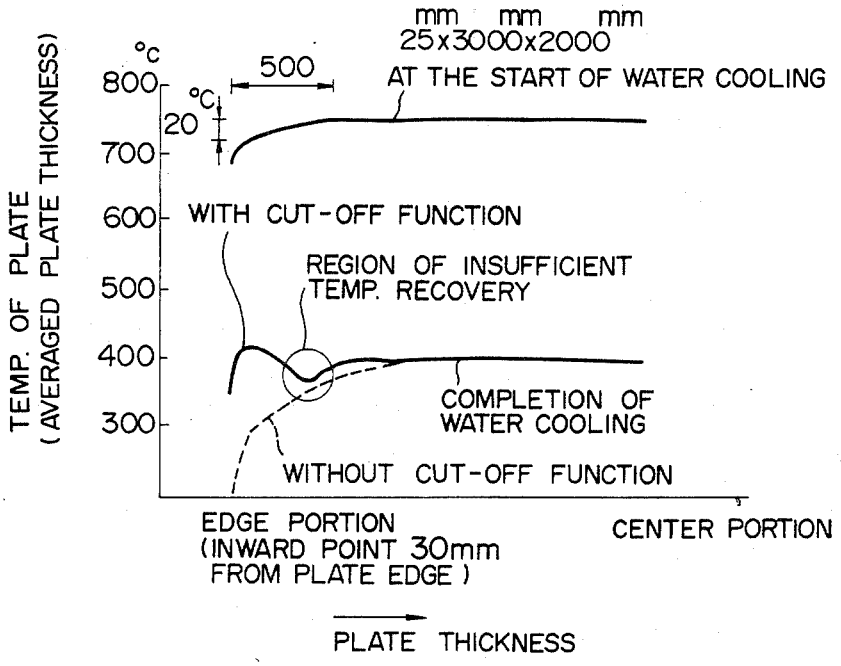
FIG. 13 is a graph of variations in the temperature of a steel plate upon completion of cooling, according to the presence and the absence of a cooling-water shield function.

In a typical prior-art method, the cooling water supplied to the edge portions of a steel plate is controlled by opening and closing each nozzle in a controlled manner. Therefore, as shown in FIG. 13, the tendency of the temperature differences which are produced upon completion of the cooling of the edge portions in a forced cooling process using no function of cutting off the supply of cooling water is different from the tendency of temperature-dependent recovery which appears after completion of a cooling process using the function of cutting off the supply of cooling water. In consequence, a cooled portion showing unsatisfactory temperature-dependent recovery is formed around the boundaries between the center and the edge portions of the steel plate. When a temperature drop occurs in such boundaries, even if there is no temperature difference between the center and the widthwise edge portions, the shape of the steel plate is easily impaired after completion of forced cooling, thus leading to the formation of edge waviness.

If a small level of temperature drop occurs in a boundary (for example, $\Delta T < \leqq 30°$ C.), the shape the cooled plate after water cooling is good. However, when such plate product is cut widthwise in a slit manner, phenomenon such as warpage and curvature take places after the cutting, so that the shape needs to be corrected. In particular, when a temperature at which water cooling is completed is not higher than 500° C. (averaged plate thickness), such temperature drop easily occurs around the boundaries, but, when such temperature is 550° C. or higher, the temperature drop does not substantially occur.

Figure 14A:
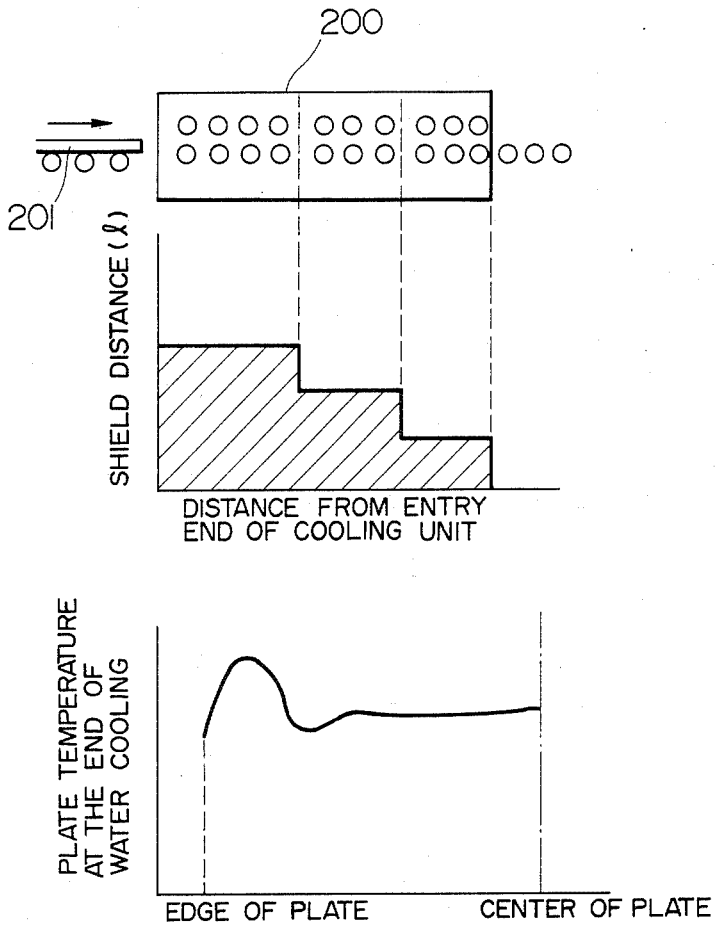
FIGS. 14*a* and 14*b* include graphs of the relationship between the temperature of a steel plate upon completion of cooling and a cooling-water shield patterns of the prior art.

Another problem of the prior art will be described with reference to FIG. 14*a*. As shown, a cooling device 200 is divided into three zones in the lengthwise direction, and the shield length of each of the zones is indicated by a distance ( from the edge portion of the plate and represented by slanting lines in FIG. 14*b*. The shield distance ( becomes smaller toward the exit end of the cooling device. In such shield method, since the portion which is shielded from cooling in the edge portion of a plate 201 is formed in a straight line in each water cooling zone, the efficiency of water cooling the shielded portion greatly differs from that of water cooling the nonshielded portion, leading to the problem that temperature is varied in a stepped manner. If the steel plate 201 is subjected to temperature showing such stepped pattern, even if the temperature at which water cooling is stopped is uniformly distributed throughout the plate, waviness and warpage are easily formed on the edge portions of the plate.

Figure 14B:
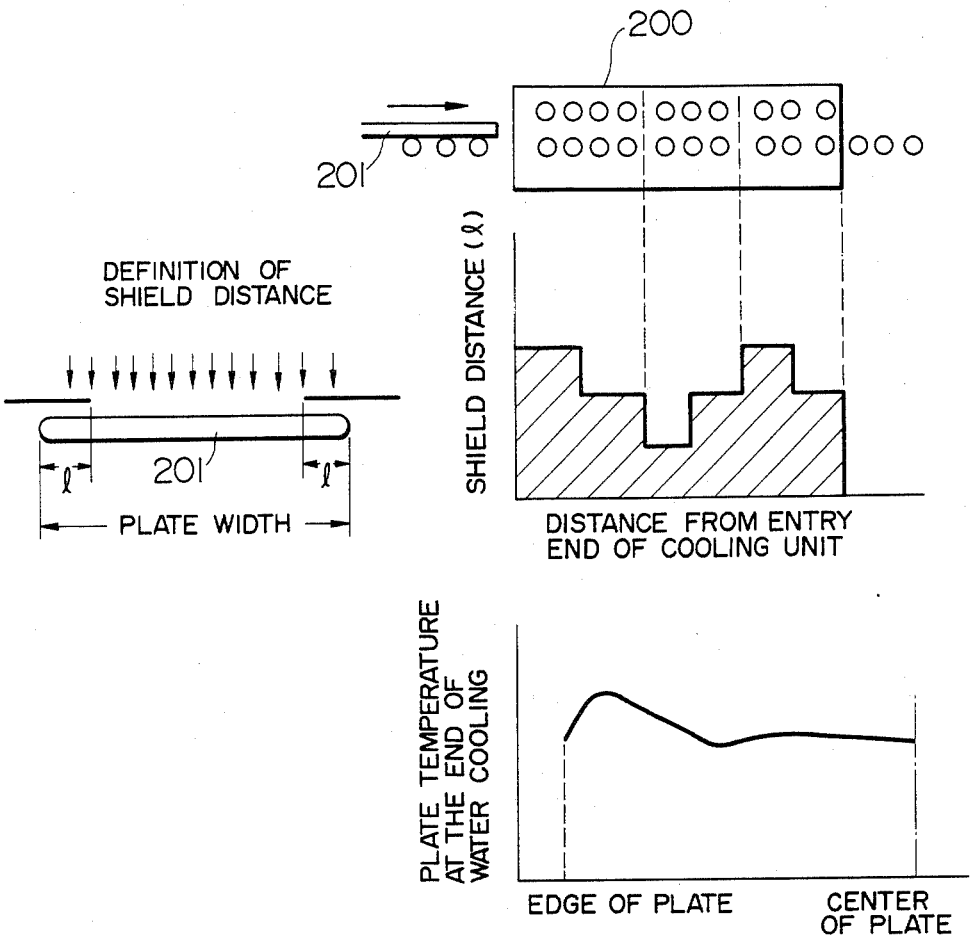

To solve the problem, Japanese patent unexamined publication No. 174833/1985 discloses the shield method shown in FIG. 14*b*. In this method, the number of shield nozzles which are arranged lengthwise above and below the steel plate 201 is suitable increased or decreased along the length of the cooling device. Solely when a forced cooling device has a sufficient length and a large number of shield means are provided therein, a certain level of correction is enabled. However, running cost is high and also it is impossible to perfectly prevent the occurrence of waviness and warpage on the steel plate.

An illustrative cooling method described below has been devise by taking notice of the temperature patterns which are formed widthwise in the plate during a water-cooling process, in particular, in the edge portions of the plate, and is intended for controlling the rate at which each nozzle supplies cooling water to the edge portions of the plate so that such temperature patterns may be controlled within a predetermined temperature difference, thereby producing a steel plate having a good shape.

The following description concerns an example of cooling a hot steel plate (35 mm×3,000 mm×40,000 mm) by using the above-described cooling method.

Cooling conditions are as follows:

Temperature at which water cooling is started: 750° C.;

Temperature at which water cooling is completed: 450° C.;

Water cooling time: 11 sec.

The nozzles are disposed widthwise between feed rolls and retaining rolls above and below a plate, being spaced apart from each other by 75 mm. The rate at which each of the nozzles supplies cooling water is listed in Table V together with that of the prior art. Incidentally, the feed rate was set to 60 mm/min.

Figure 12:
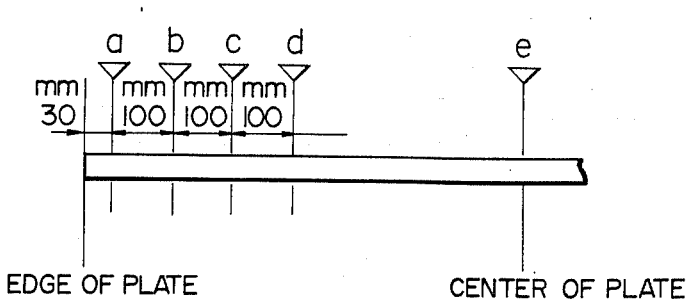
FIG. 12 is a diagram of the layout of thermometers disposed adjacent to an exit end.

In order to measure the temperature of the plate upon completion of water cooling, widthwise temperatures were measured at points a, b, c, d, and e shown in FIG. 12. The results of measurement of the temperatures and the measured values of plate blending deformation are shown together with the values of the prior art at the bottom of Table V.

As can be seen from Table V, while, in the prior art, the maximum temperature difference is 25° C. and the extent of plate bending deformation is 8 mm, the maximum temperature difference and the plate bending deformation are greatly improved to 5° C. and 2 mm, respectively, in accordance with the present invention. In addition, as will be understood from Table V, since a significant number of nozzles may not supply water in the method in accordance with the present invention, it is possible to save energy as compared with the prior art.

TABLE V

| | NOZZLE NO. (WIDTHWISE) | PRIOR-ART METHOD | | | | | | | | | | | ABOVE-DESCRIBED METHOD OF THIS INVENTION | | | | | | | | | | |
|---|---|---|---|---|---|---|---|---|---|---|---|---|---|---|---|---|---|---|---|---|---|---|---|
| | | NOZZLE NO. (TRAVEL DIRECTION) | | | | | | | | | | | | | | | | | | | | | |
| | | L1 | L2 | L3 | L4 | L5 | L6 | L7 | L8 | L9 | L10 | L11 | L1 | L2 | L3 | L4 | L5 | L6 | L7 | L8 | L9 | L10 | L11 |
| FLOW RATE IN EACH NOZZLE (l/min.) | $A_1$ | 35 | 35 | 35 | 35 | 35 | 35 | 35 | 35 | 35 | 35 | 35 | 0 | 0 | 0 | 0 | 0 | 0 | 0 | 0 | 0 | 0 | 0 |
| | $A_2$ | 60 | 60 | 60 | 60 | 60 | 60 | 60 | 60 | 60 | 60 | 60 | 0 | 0 | 0 | 0 | 0 | 0 | 0 | 0 | 0 | 0 | 0 |
| | $B_1$ | 35 | 35 | 0 | 35 | 35 | 35 | 35 | 35 | 35 | 35 | 35 | 0 | 0 | 18 | 18 | 18 | 18 | 18 | 18 | 18 | 18 | 18 |
| | $B_2$ | 60 | 60 | 60 | 0 | 60 | 60 | 60 | 60 | 60 | 60 | 60 | 0 | 0 | 30 | 30 | 30 | 30 | 30 | 30 | 30 | 30 | 30 |
| | $C_1$ | 35 | 0 | 0 | 0 | 35 | 35 | 35 | 35 | 35 | 35 | 35 | 0 | 0 | 26 | 26 | 26 | 26 | 26 | 26 | 26 | 26 | 26 |
| | $C_2$ | 0 | 60 | 60 | 0 | 0 | 60 | 60 | 60 | 60 | 60 | 60 | 0 | 0 | 45 | 45 | 45 | 45 | 45 | 45 | 45 | 45 | 45 |
| | $D_1$ | 0 | 0 | 0 | 0 | 0 | 35 | 35 | 35 | 35 | 35 | 35 | 0 | 0 | 35 | 35 | 35 | 35 | 35 | 35 | 35 | 35 | 35 |
| | $D_2$ | 0 | 0 | 60 | 0 | 0 | 60 | 60 | 60 | 60 | 60 | 60 | 0 | 0 | 60 | 60 | 60 | 60 | 60 | 60 | 60 | 60 | 60 |
| | $E_1$ | 0 | 0 | 0 | 0 | 0 | 35 | 35 | 35 | 35 | 35 | 35 | 0 | 0 | 35 | 35 | 35 | 35 | 35 | 35 | 35 | 35 | 35 |
| | $E_2$ | 0 | 0 | 0 | 0 | 0 | 60 | 60 | 60 | 60 | 60 | 60 | 0 | 0 | 60 | 60 | 60 | 60 | 60 | 60 | 60 | 60 | 60 |
| | $F_1$ | 0 | 0 | 35 | 0 | 0 | 35 | 35 | 35 | 35 | 35 | 35 | 0 | 0 | 35 | 35 | 35 | 35 | 35 | 35 | 35 | 35 | 35 |
| | $F_2$ | 0 | 0 | 0 | 60 | 0 | 60 | 60 | 60 | 60 | 60 | 60 | 0 | 0 | 60 | 60 | 60 | 60 | 60 | 60 | 60 | 60 | 60 |
| FLOW RATE IN EACH NOZZLE (l/min.) | $G_1$ | 0 | 35 | 35 | 35 | 0 | 35 | 35 | 35 | 35 | 35 | 35 | 18 | 18 | 35 | 35 | 35 | 35 | 35 | 35 | 35 | 35 | 35 |
| | $G_2$ | 60 | 0 | 0 | 60 | 60 | 60 | 60 | 60 | 60 | 60 | 60 | 30 | 30 | 60 | 60 | 60 | 60 | 60 | 60 | 60 | 60 | 60 |
| | $H_1$ | 35 | 35 | 35 | 35 | 35 | 35 | 35 | 35 | 35 | 35 | 35 | 26 | 26 | 35 | 35 | 35 | 35 | 35 | 35 | 35 | 35 | 35 |
| | $H_2$ | 60 | 60 | 0 | 60 | 60 | 60 | 60 | 60 | 60 | 60 | 60 | 45 | 45 | 60 | 60 | 60 | 60 | 60 | 60 | 60 | 60 | 60 |
| | $I_1$ | 35 | 35 | 35 | 35 | 35 | 35 | 35 | 35 | 35 | 35 | 35 | 35 | 35 | 35 | 35 | 35 | 35 | 35 | 35 | 35 | 35 | 35 |
| | $I_2$ | 60 | 60 | 60 | 60 | 60 | 60 | 60 | 60 | 60 | 60 | 60 | 60 | 60 | 60 | 60 | 60 | 60 | 60 | 60 | 60 | 60 | 60 |
| | $J_1$ | 35 | 35 | 35 | 35 | 35 | 35 | 35 | 35 | 35 | 35 | 35 | 35 | 35 | 35 | 35 | 35 | 35 | 35 | 35 | 35 | 35 | 35 |
| | $J_2$ | 60 | 60 | 60 | 60 | 60 | 60 | 60 | 60 | 60 | 60 | 60 | 60 | 60 | 60 | 60 | 60 | 60 | 60 | 60 | 60 | 60 | 60 |
| TEMPERATURE UPON COMPLETION OF COOLING (IN AVERAGED PLATE THICKNESS) | a | | | | | | 445 °C. | | | | | | | | | | | 445 °C. | | | | | |
| | b | | | | | | 470 | | | | | | | | | | | 449 | | | | | |
| | c | | | | | | 445 | | | | | | | | | | | 450 | | | | | |
| | d | | | | | | 448 | | | | | | | | | | | 450 | | | | | |
| | e | | | | | | 450 | | | | | | | | | | | 450 | | | | | |
| MEASURED VALUE OF DEGREE OF PLATE DEFORMATION | | | | | | | 8 mm | | | | | | | | | | | 2 mm | | | | | |

In accordance with the hot-plate cooling method which has been illustratively described above, while a hot-rolled steel plate is being subjected to forced cooling, uniform cooling is effected widthwise by correcting the widthwise temperature difference before the water cooling and the temperature difference caused by widthwise partial cooling which occurs during tte cooling, whereby it is possible to provide a method of cooling a steel plate having uniform temperature distribution in the widthwise direction during and after the cooling. This method provides the following advantages.

It is possible to obtain a steel plate showing a uniform strength distribution and having a good shape upon completion of cooling. Since a reduced level of residual stress remaines in a water cooled steel plate, if the cooled plate is cut in a slit manner, no substantial warpage is formed on the steel. Since it is possible to shut off the water which should be supplied to the nozzles disposed outside of the widthwise ends of a plate to be water cooled, unnecessary cooling water is not used, so that energy can be saved.

What is claimed is:

1. A method of cooling a hot-rolled steel plate in which, while a hot-rolled steel plate P is being advanced lengthwise, the distribution of cooling water supplied to the opposite surfaces of said steel plate P is controlled along the length and width of said steel plate P through a plurality of nozzles disposed adjacent to said opposite surfaces of said steel plate P and in the lengthwise and widthwise directions of a predetermined cooling zone provided along a passage through which said steel plate P is advanced, thereby water cooling said steel plate P to a predetermined temperature at a predetermined cooling velocity, which comprises the steps of:

detecting, at a first group of temperature measurement points which are present over the width of said steel plate P, the temperatures in a plurality of cross-sectional areas in the thicknesswise direction at predetermined lengthwise positions of said steel plate P; and further detecting temperatures at a second group of temperature measurement points which are present along said width in said cross-sectional areas, before, during and after water cooling;

calculating the temperature differences between said detected temperatures at said first and second temperature measurement points in the direction of said width and said thickness along said width, each time the detection is performed;

forecasting the extent of bending deformation in widthwise and lendthwise directions of said steel plate P after said cooling process, on the basis of said obtained temperature differences, each time the calculation is performed; and controlling and correcting, by means of said plurality of nozzles, the distribution of the rate at which cooling water is being supplied to a steel plate and the rate at which said cooling water should be supplied to the ensuing steel plates whenever said forecasted extent of deformation exceeds an allowable range.

2. A method according to claim 1, wherein said temperature difference used for forecasting said extent of deformation is the maximum temperature difference between said temperature measurement points.

3. A method according to claim 1, wherein said temperature difference used for forecasting said extent of deformation is the averaged value of said temperature differences between said temperature measurement points.

4. A method according to claim 1, wherein said plurality of temperature measurement points which are present along said width in said cross-sectional area are provided in the widthwise edge portions and the center therebetween.

5. A method according to claim 1, wherein said opposite edge portions are at least 50 mm inward of the opposite edges of said steel plate P.

6. A method according to claim 1, wherein, when the thickness of a steel plate to be water cooled is 16 mm or less, the temperature difference between the opposite surfaces of said steel plate is used as the temperature difference in the direction of said thickness in said cross-sectional area.

7. A method according to claim 1, wherein when the thickness of a steel plate to be water cooled is 20 mm or more the internal temperature difference of the steel plate is calculated by a known equation for forecasting the internal temperature of said steel plate on the basis of the temperatures at the top and the bottom of said steel plate, such internal temperature difference being used as the temperature difference in the direction of said cross-sectional area.

8. A method according to claim 1 further comprising the steps of:

temporarily setting the rate of the water supplied by said plurality of nozzles on the basis of conditions such as the type of a plate, rolling conditions, plate size, cooling conditions, positions at which temperatures are measured along the length of said steel plate, and positions at which thermometers are arranged, forecasting the temperature differences which are produced by the temporarilty set water-supply rate between said respective temperature measurement points;

correcting said temporarily set water-supply rate whenever said forecasted degree is not within an allowable range, thereby controlling said extent of plate deformation within said allowable range; and starting the water cooling of said steel plate on the basis of said temporarily set water-supply rate which is thus corrected.

9. A method according to claim 1 further comprising the steps of:

measuring the extent of said plate bending deformation at the end of said water cooling;

comparing said forecasted extent of plate deformation with said measured extent of plate deformation; and correcting an arithmetic equation for forecasting said plate bending deformation whenever the difference between said forecasted and measured values is not within an allowable range.

10. A method according to claim 1, wherein said arithmetic equation for forecasting said extent of plate bending deformation is represented by;

$$u_0 = \sum_{\iota} a \cdot T_{\iota} + k$$

where, $u_0$ represents an extent of plate deformation;

represents positions of said thermometers which are disposed in order to detect the temperatures of said plurality of temperature measurement points in said cross-sectional areas at the predetermined lengthwise positions on said steel plate;

$T_i$ is an averaged value or the maximum value of the temperature differences between said temperature measurement points which are arranged over the width in the direction of either said width or the thickness in said cross-sectional areas of said steel plate;

a is an influence factor relating to steel plate shape, steel plate temperature and cooling process; and k is a constant.

11. A method according to claim 1 further comprising the steps of:

measureing the extent of plate deformation at the end of said water cooling;

comparing said forecasted extent of plate bending deformation with this measured extent of plate deformation; and correcting said influence factor a and said constant k of said arithmetic equation when the difference between said forecasted and measured values is not within an allowable range.

12. A method according to claim 1 further comprising the steps of:

measuring the extent of said plate bending deformation in the normal temperature condition after completion of said water cooling;

comparing said forecasted extent of plate deformation with this measured extent of plate deformation; and correcting an arithmetic equation for forecasting said plate bending deformation whenever the difference between the forecasted and measured values is not within an allowable range.

13. A method according the claim 1 comprising the steps of:

measuring the extent of plate deformation in the normal temperature condition after completion of said water cooling;

comparing said forecasted extent of plate bending deformation with this measured extent of plate deformation; and correcting said influence factor a and said constant k of said arithmetic equation when the difference between the forecasted and measured values is not within an allowable range.

* * * * *